US008052839B2

(12) United States Patent
Pikka et al.

(10) Patent No.: US 8,052,839 B2
(45) Date of Patent: Nov. 8, 2011

(54) APPARATUS AND METHOD FOR WASHING PULPS

(75) Inventors: Olavi Pikka, Karhula (FI); Pekka Tervola, Espoo (FI); Hannu Rönkönharju, Karhula (FI)

(73) Assignee: Andritz Oy, Helsinki (FI)

( * ) Notice: Subject to any disclaimer, the term of this patent is extended or adjusted under 35 U.S.C. 154(b) by 964 days.

(21) Appl. No.: 11/574,687

(22) PCT Filed: Sep. 7, 2005

(86) PCT No.: PCT/FI2005/000382

§ 371 (c)(1), (2), (4) Date: Jan. 2, 2008

(87) PCT Pub. No.: WO2006/027414

PCT Pub. Date: Mar. 16, 2006

(65) Prior Publication Data

US 2008/0196848 A1 Aug. 21, 2008

(30) Foreign Application Priority Data

Sep. 7, 2004 (FI) ..... 20041161

(51) Int. Cl.
*D21C 9/02* (2006.01)

(52) U.S. Cl. ..... 162/60; 162/315; 210/402; 210/784

(58) Field of Classification Search ..... 162/60, 162/315; 210/402, 784
See application file for complete search history.

(56) References Cited

U.S. PATENT DOCUMENTS

| | | | | |
|---|---|---|---|---|
| 3,587,257 | A | 6/1971 | Hurter | |
| 4,440,596 | A * | 4/1984 | Shannon | 162/106 |
| 5,275,024 | A * | 1/1994 | Parks | 68/9 |
| 5,482,594 | A * | 1/1996 | Salminen | 162/60 |
| 5,641,402 | A | 6/1997 | Kohonen et al. | |

OTHER PUBLICATIONS

International Search Report mailed Dec. 22, 2005.

* cited by examiner

*Primary Examiner* — Matthew Daniels
*Assistant Examiner* — Jacob Thomas Minskey
(74) *Attorney, Agent, or Firm* — Nixon & Vanderhye P.C.

(57) ABSTRACT

An apparatus for treating pulp including: at least one liquid-permeable surface rotating around a shaft, onto which surface a pulp layer is formed; a feeder to feed pulp to the apparatus for treatment on the liquid-permeable surface; an internal barrier defining a first pulp treatment section and a second pulp treatment section; the first treatment section receiving from the feeder a first type of pulp and the second treatment section receiving from the feeder a second type of pulp, wherein the first type of pulp is supplied to the feeder from a first pulp treatment stage in a pulping system and the second type of pulp is supplied to the feeder from a second pulp treatment stage in the pulping system, and a pulp discharge to discharge treated pulp from the apparatus, wherein the pulp discharge discharges the first type of pulp after treatment separately from discharging the second type of pulp after treatment, and a filtrate discharge to discharge filtrate flowing through the liquid-permeable from the apparatus.

27 Claims, 6 Drawing Sheets

APPARATUS AND METHOD FOR WASHING PULPS

This application is the U.S. national phase of international application PCT/FI2005/000382 filed 7 Sep. 2005 which designated the U.S. and claims benefit of Finnish Application No. 20041161 filed 7 Sep. 2004, the entire contents of both are hereby incorporated by reference.

The present invention relates to an apparatus for treating pulp, said apparatus comprising at least one rotating surface arranged around a shaft, on which surface a pulp web is formed, means for feeding pulp onto the rotating surface, means for discharging pulp from the apparatus and means for removing filtrates from the apparatus. The apparatus is especially well applicable for washing of pulp. The invention also relates to a method.

In the cellulose pulp industry, especially in the sulfate pulp industry, liquid is removed from the pulp and/or the pulp is washed in various apparatuses after digestion and between and after bleaching stages. Pulp is washed in brown stock washing after digestion and after oxygen delignification for recovering black liquor and cleaning the pulp free of dissolved impurities. In connection with bleaching, the purpose of the wash is to separate dissolved substances from the pulp after bleaching reactions and to prepare the pulp for further treatments. A feature common to these washing processes is that a filtrate or filtrates are obtained from the washing apparatuses, which substances are reused at a suitable location in the process, such as in an earlier washing stage in countercurrent washing of the pulp.

Prior art knows many different kinds of washing apparatuses and methods. Clearly distinguishable from each other are diffusers, drum washers and Fourdrinier washers. Some examples of drum washers used at present are suction washers, washing presses and pressurized or overpressure washers.

A conventional suction washer comprises a wire-coated drum rotating in a basin. Collecting chambers are arranged in the drum shell under a perforated plate, said chambers being connected each via a dedicated pipe to a valve system located on a shaft at the end of the drum. From the valve, the filtrate is led through a suction leg or a centrifugal pump generating the required suction effect into e.g. a filtrate container. The valve construction allows for arranging the suction effect suitably at desired points along web formation.

Web formation in a suction washer takes place so that by means of the suction leg, or some other apparatus generating suction, a vacuum is arranged inside a drum rotating in a basin, which vacuum withdraws pulp suspension from the basin against the drum. As liquid penetrates the drum, the fibers of the pulp accumulate on the surface of the drum. The consistency of the fiber suspension in the basin is about 0.5-2%, and the consistency of the layer precipitated on the drum is about 10-12%. The web-formation area, i.e. the part of the drum's circumference, which is in the basin covered by fiber suspension, is about 140 degrees. The maximum rotational speed of the drum is 2-2.5 r/min., because the collecting chambers and pipes for the filtrate would not have enough time to empty, if the speed was higher.

The wash is effected by displacement so that washing liquid is sprayed onto the surface of the drum emerging from the pulp basin, which washing liquid is absorbed through the pulp layer under the effect of vacuum and displaces most of the liquid originally present in the pulp. Thus, the extent of the displacement zone is about 120 degrees. The washed pulp web is removed from the drum by disrupting the suction.

Press washing is a washing method that has been used for long. The operation of a washing press is based on either a simple dilution mixing and pressing or a combination of dilution, thickening, displacement and pressing.

Typically a washing press comprises at least one drum having a wire-coated or drilled perforated plate casing. Pulp is typically fed in at a consistency of 1-12%, e.g. at a consistency of 3-8%. The drum shell is typically provided with compartments, wherefrom the filtrate is led out via a chamber at the end periphery. The drum may also be open, whereby the filtrate is collected inside the drum and led out via an opening at the end of the drum. In one press solution, the pulp is fed in a section between the perforated drum and the basin partly surrounding the drum, which section narrows in the rotational direction of the drum. Thus, a pulp web is formed on the surface of the drum or drums, whereafter washing liquid is fed into the pulp. The purpose of the washing liquid is to partly displace the liquid in the pulp and partly to dilute the pulp. Pulp is led into a narrow slot i.e. nip between the drums or drum and a press roll by means of the rotating movement of the drums or drum and the press roll, and thus removal of water is effected via the openings in the drum. This filtrate is collected into a filtrate container, wherefrom it is led further. In one washing press solution, the pulp suspension is introduced into a nip between two drums in order to form a pulp web onto the surfaces of the drums. After the nip, the pulp is washed and the pulp web thickened by pressing it in a narrowing slot between the drum and a washing flap partly surrounding the drum. The washed pulp may have a consistency up to 25-40%. However, the displacement is typically carried out at a consistency of 10-15%. Washing presses have been presented e.g. in publications EP 1098032 and WO 02/059418.

The DRUM DISPLACER®—washer of Andritz Oy may be mentioned as an exemplary pressurized drum washer. A similar apparatus has been discussed in e.g. Finnish patent publications 71961 and 74752 (corresponding to U.S. Pat. Nos. 4,919,158 and 5,116,423). The apparatus mainly comprises a rotary drum and a stationary shell surrounding the drum. The treatment is pressurized and it is effected by arranging outside the drum an outer shell via which washing liquid is fed into the pulp on the drum. The drum comprises a perforated cylinder, the outer surface of which is provided with ribs arranged at certain intervals in the longitudinal direction of the drum. Said ribs together with the perforated cylinder surface form the so-called pulp compartments. Filtrate compartments are arranged inside the cylinder, under the pulp compartments, which filtrate compartments receive the filtrate displaced by the washing liquid. A valve arrangement is provided at the end of the cylinder drum essentially on the diameter of the circumference of the drum, via which arrangement the filtrate is removed and led further. The washer is provided with multiple, usually 3-4, stages. This means that the washing liquid is used several times for washing the pulp. In other words, filtrates collected in the filtrate compartments are led countercurrently from one washing stage of the washer to another. Feed chambers for the washing liquid, wherefrom the washing liquid is pressed through the perforated plate into the pulp in the pulp compartments for displacing the liquid in the pulp, are located outside the washer drum, integrated in the washer shell.

Web formation and pulp washing are effected so that the pulp to be washed is fed via a specific feed box into the pulp compartments. The consistency of the pulp being fed to the washer drum may vary between 4-12%. The feeding pressure is 0.2-0.6 bar. The feed box thickens the pulp and axial "planks" having a length equal to the length of the drum are formed in the pulp compartments. The pressure difference, which forms and thickens the pulp web, is equal to the feeding pressure. Immediately after the feeding point follows the first washing stage of the drum. Each stage receives a washing liquid flow, which when being pressed into the pulp layer in the compartments of the washer drum, displaces the liquid therein. The washing consistency is typically between 10-14%. The rotational speed of the drum varies between 0.5-4.0 rpm.

It was already mentioned before that the filtrates are led countercurrently from one stage to another. To put it differently (see FI patent 74752, FIG. 1) the last washing stage receives clean washing liquid and the filtrate displaced by that liquid is led as washing liquid to the last but one washing stage. The last washing stage is followed by a suction stage, wherein the consistency of the pulp rises into 13-16%. The liquid separated from the pulp in the suction stage is taken as washing liquid into a washing stage preceding the suction stage in the washer. The pulp is removed from the drum, e.g. by means of pressurized air blow, and transferred further by a screw transporter. EP-patent publication 856075 discloses an intensified arrangement for washing pulp, which may be applied e.g. in drum washers.

Although pulp washing apparatuses as such are often efficient and clean the pulp to a sufficient extent in the process stage where they are located, their often large size and corresponding great space requirement create problems. As the pulp often has to be washed after almost each treatment stage, such as bleaching stage, several washers are needed at a cellulose pulp mill: brown stock washer(s), oxygen stage washer, bleaching plant washers. Several washers with their large shells also cause remarkable material expenses. In addition to that, in conventional practice, filtrates from washing and thickening apparatuses have been allowed to flow under gravity into normally cylindrical standing filtrate containers, wherefrom the filtrates have then been pumped by means of a pump to be reused, in general to some other washing or thickening apparatus. A typical bleaching plant comprises e.g. four filters and below each of them a filtrate container typically having a volume of 50-150 $m^3$. Filtrates are pumped from each container usually by means of at least two pumps to be used in different locations. Typically the filtrate containers are located 10-15 meters below the washing apparatuses. This kind of filtrate collection and reuse system is efficient as such, but expensive. Multiple tanks and extensive pipings and instrumentation systems related to them are expensive. Further, the pumpings require a remarkable amount of energy.

U.S. Pat. No. 5,275,024 discloses a wire-type washer capable of washing two pulps. The pulps, which may come from different treatment stages, are led to different sides of the wire. In a first wash, the pulp is led onto the upper surface of the wire. After the wire has been emptied, it is recirculated, whereby a pulp from a different treatment stage is led onto the other side of the wire. A disadvantage of this apparatus is that the wire gets into contact with various pulps, which is demanding in view of the durability of the wire material. The wire material must be selected in view of e.g. the pH according to the pulp coming from the most severe conditions.

The object of the present invention is to provide a system for treating pulp, which eliminates disadvantages described in the above. Thus, the construction of the novel arrangement is simpler and less space consuming, resulting in decreased material costs and reduced energy requirements due to decreased need for pumpings. An object is also the possibility to choose the material for a certain treatment surface, such as washing surface, in view of the exact pulp that is treated, e.g. washed, on that specific treatment surface.

In order to reach the above objects, the present invention is characterized in being provided with at least one inside construction for forming at least two treatment sections in the apparatus so that each section is connected to at least means for feeding one pulp in such a way that the pulps being treated in said sections originate from essentially different treatment stages, to pulp discharge means so that the treated pulps are discharged from the apparatus separately.

The invention is based on the concept that an apparatus having a rotating filtrate surface is capable of treating simultaneously two pulps differing from each other in view of some properties, which pulps preferably enter the apparatus from different treatment stages, e.g. brown stock and oxygen-delignified pulp. Typically the pulps treated in different sections differ from each other in view of at least one property, such as pH, degree of delignification, brightness etc. The apparatus according to the invention differs from prior art apparatuses for thickening and washing pulp in that it has at least two separate treatment sections, preferably washing sections, formed by means of an inside construction, such as an intermediate wall or walls. One section may be meant primarily for thickening the pulp and it does not specifically receive washing liquid, but most typically the apparatus according to the invention functions as an apparatus, in the washing sections of which pulp is washed with liquid.

Inside construction refers to a construction or equipment, by means of which the interior of an apparatus for treating pulp, e.g. a washing apparatus, is divided into suitable sections so that the pulp may be treated, e.g. washed, in said sections in such a way that the processes in each of the sections may be carried out as desired without disturbances.

The inside construction is to be fitted so that the pulps being treated, e.g. washed, in different sections, and the filtrates generated in the treatment thereof, are kept essentially apart without letting them mix with each other. A typical inside construction is a plate formed by an intermediate wall, which plate is provided with a hole or an opening for leading in a washer shaft and a rotating surface. The intermediate wall is essentially perpendicular to the shaft of the rotating surface. Essentially perpendicular in connection with this invention means that the intermediate wall may be arranged slanting in relation to the plane, which is perpendicular to the shaft of the rotating surface, the angle of tilt being less than 30°. The inside construction may as well comprise something else than a plate-form intermediate wall. The inside construction has to be such that the processes in the treatment sections of the apparatus do not disturb each other e.g. via substance leakages.

Each section of the apparatus has dedicated conduits for feeding pulp to be treated into said section and discharging therefrom, as well as for discharging the formed filtrate therefrom. Preferably the sections have been connected to filtrate discharge apparatuses so that the filtrates are discharged from the apparatus separately. The sections are preferably provided with conduits for feeding washing liquid into said washing section.

The solution according to the present invention may preferably be applied in washing apparatuses, wherein the washing surface is formed of a drum or a number of rotating discs rotating around a shaft. The rotating surface may be surrounded by a housing.

The construction of drum washers changes in accordance with the invention in such a way that the drum and the space surrounding it are divided by means of an inside construction or piece, preferably an intermediate wall, into at least two parts. Thus, different pulps are washed at various ends of the drum. The inside construction, such as an intermediate wall, and the lead-ins therein must be such that detrimental substance leakages, such as pulp leakages, from one section to another are essentially prevented. Thus, pulps and washing filtrates being treated in separate washing sections cannot mix with each other. The invention may be applied both in pressure drum filtrate washers and suction drum filtrate washers. Accordingly, the invention may be applied in single or two drum washing presses as well, wherein the filtering surface of the press drum/drums and the surrounding section are divided by means of an inside construction, such as an intermediate wall, into at least two washing sections. The invention may also be applied in thickeners.

The filtering member may also be formed of a number of discs having a filtering surface and rotating around a horizontal shaft. In the construction according to the invention, each washing section separated by an inside construction has the number of discs required in that specific section.

Typically, pulps coming from successive stages in the production line are treated in various sections of one and the same apparatus. Thus, the same apparatus may be used for washing brown stock and oxygen delignified pulp or acid treated and alkali extracted pulp or pulps treated in different chlorine dioxide stages, such as $D_1$- and $D_2$-stages. Which pulps are treated in each washing apparatus is naturally determined based on the treatment stages, such as the bleaching sequence, of the pulping line in question.

The invention may also be applied to existing apparatuses by providing them with an appropriate inside construction for forming treatment sections and with conduits for liquid and pulp flows required in said sections.

The invention also relates to a method for treating pulp, in which method the pulp is fed onto a liquid-permeable surface rotating around a shaft of the treating apparatus, onto which surface a pulp layer is formed, liquid is removed from said pulp layer, and the treated pulp is discharged from the apparatus. A characterizing feature is that on the rotating surface a first layer is formed of pulp coming from a first treatment stage, and a second layer is formed of a pulp coming from a second treatment stage in a distance from the first layer in the longitudinal direction of the shaft, and the pulp layers are treated essentially separately from each other. Preferably means, such as an intermediate wall, is arranged between the pulp layers, for forming separate sections so that said means prevents detrimental substance leakages from one treatment section to another. Typically, the treatment of pulp is washing. In one and the same apparatus, the first pulp may be brown stock and the second pulp an oxygen delignified pulp, or the first pulp comes from a first bleaching stage and the second pulp from a second bleaching stage, or the first pulp comes from an acid stage, especially from hexenuronic acid discharge stage known per se, and the other pulp from an alkali extraction stage. The washing liquid of one section may be washing filtrate from another section. According to one embodiment, the washing section is divided into washing stages so that washing filtrate from a certain stage is led in the flow direction of the pulp into at least one preceding stage to be used as washing liquid. Different filtrates may be obtained from one treatment section. According to one embodiment, different washing liquids are led to various points of the pulp layer in the washing section.

Advantages of the present invention include e.g. a remarkable space saving and reduced number of apparatuses, which both decrease expenses. Further, each washing section and the washing surface therein is used for treating a pulp entering from one treating stage only, whereby the conditions, such as the material of the washing surface, may be chosen based on the properties of that specific pulp. Accordingly, the size of the washing section is essentially dependent on the amount of pulp treated and its properties, such as filtration properties.

In the following, the apparatus according to the invention is explained in greater detail with reference to the appended Figures, in which FIG. 1 shows in top view a solution for brown stock and oxygen stage washing according to prior art (FIG. 1*a*) and an embodiment according to the present invention (FIG. 1*b*);

Figure 1A:
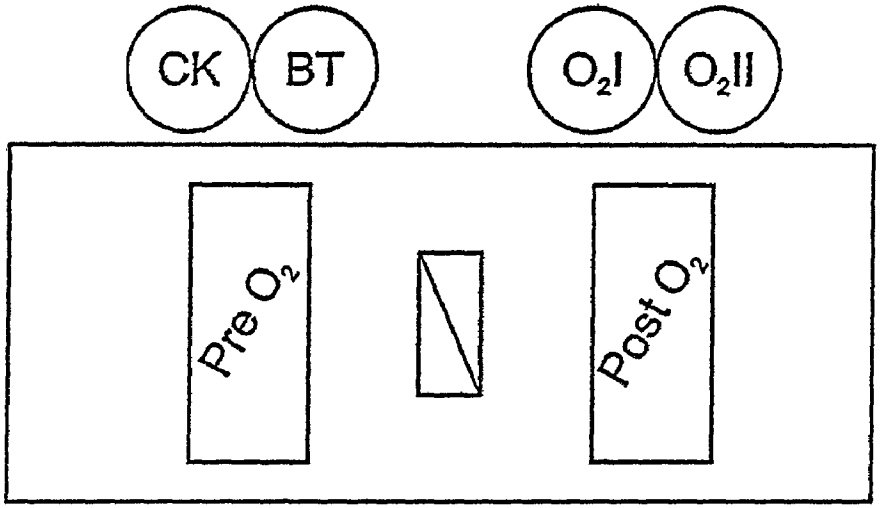

FIG. 1*a* shows a typical prior art apparatus arrangement, wherein brown stock from a digester (CK) and a blow tank (BT) is led into a brown stock washer ($PreO_2$), which is e.g. a DRUM DISPLACER®-washer (Andritz Oy). The washed brown stock is sorted and oxygen-delignified in a two-step oxygen stage comprising reactors ($O_2I$, $O_2II$). The oxygen-delignified pulp is washed in a dedicated washer ($PostO_2$). FIG. 1*a* shows that separate washers lead to a remarkable space requirement.

Figure 1B:
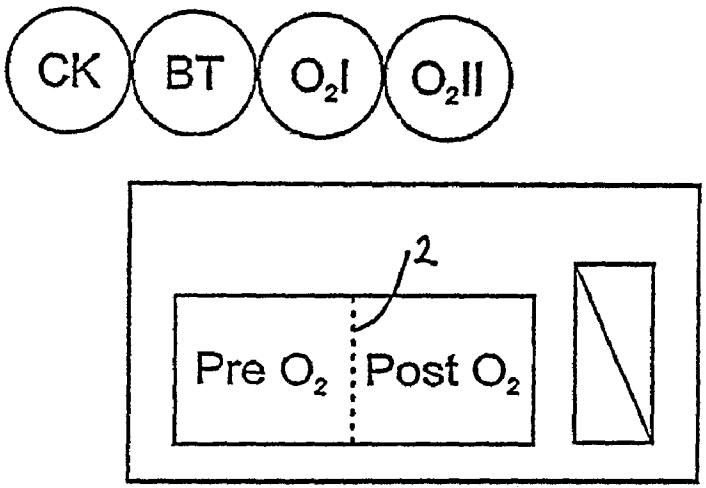

As shown in FIG. 1*b*, in accordance with the invention, two differently treated pulps coming from different treating stages are treated in one washing apparatus simultaneously, in this case brown stock and oxygen-delignified pulp. The construction of the washing apparatus designed for washing one kind of pulp only has been modified in such a way that by means of an inside construction, such as an intermediate wall 2, two separate washing sections are provided, which typically are surrounded by one and the same housing. $PreO_2$-section is used for washing brown stock from blow tank BT, and $PostO_2$-section is used for washing oxygen-delignified pulp, which is led into said section from reactor $O_2II$. FIG. 1*b* shows how remarkable a saving in space can be achieved by means of the apparatus according to the invention. In addition to the fact that the space requirement of the washing system is now about half of what it used to be, the pulp treatment vessels (CK, BT, $O_2I$, $O_2II$) can now also be located more closely to each other. A separate washer typically requires space for passage, repair and maintenance. In the solution according to the invention, such space requirement decreases significantly, as two separate washing apparatuses are replaced with one apparatus unit. Further, the required pipelines are shorter. In FIG. 1*b* the washer is located with its axis in the longitudinal direction of the building, whereby the building both narrows and shortens. Naturally, the washer may also be located in the same direction as in FIG. 1*a*.

Figure 2:
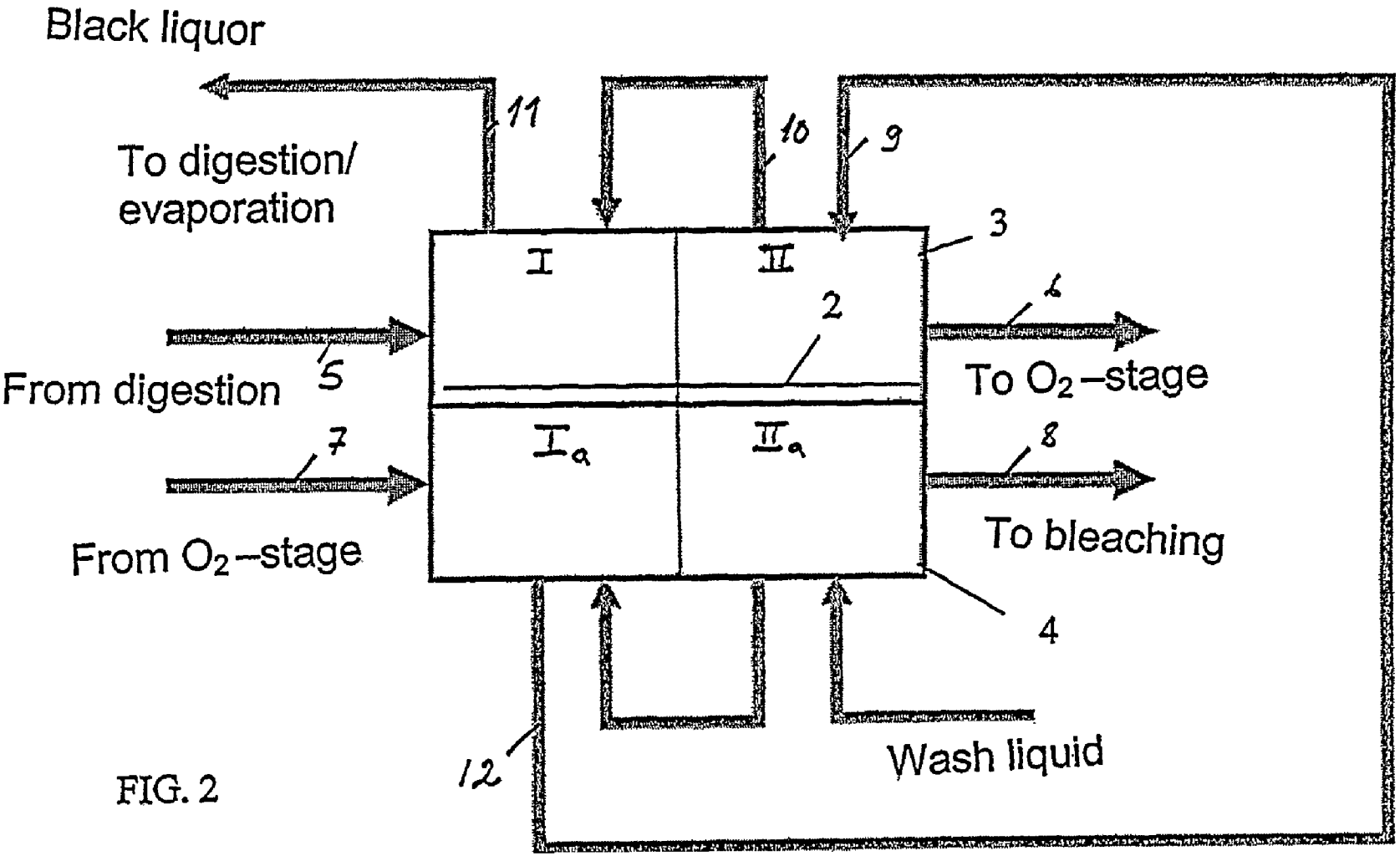
FIG. 2 is a schematic drawing of a preferred apparatus solution according to the invention.

FIG. 2 illustrates in more detail the material flow connections of FIG. 1*b* in the pulp washing apparatus according to the invention. The washing apparatus has been divided by means of an intermediate wall 2 into two washing sections, 3 and 4, for pulps introduced from different treatment stages. Brown stock is introduced from digestion via line 5 into one washing section 3, wherein the stock is washed in two stages I and II and then led via line 6 into an oxygen stage. From the oxygen stage, the pulp is led via line 7 back into the same washing apparatus, but now into the second washing section 4 (washing following the oxygen stage), wherein the pulp is again washed in two stages Ia and IIa. The washed pulp is led via line 8 to a treatment stage following the oxygen stage, which typically is a known per se high-temperature (over 85° C.) acid stage (A) for removal of hexenuronic acids, or a bleaching stage. Pulp washing in two or more stages in a single washing section comprises introducing a washing liquid (here in line 9) into a pulp layer present on the rotating surface of said washing section in the direction of the pulp layer's travelling direction to the discharge end (II) in accordance with counter-current washing. The wash filtrate 10 obtained from this stage is taken into stage I. The washing filtrate of stage I, in this case black liquor 11, is taken into digestion or an evaporation plant.

In FIG. 2, the pulp washing liquid flows as conventional counter-currently in respect of the pulp. The washing liquid is led into the latter washing stage IIa of washing section 4, which section contains the cleanest pulp inside the washing apparatus. Typically the washing liquid comes from a next washing apparatus in the flow direction of the pulp. The washing liquid then flows into the first washing stage Ia of washing section 4, and therefrom via line 12 into the latter washing stage II of the first washing section 3 of the washer and further into the first stage Ia, where the brown stock from digestion is introduced.

Figure 3A:
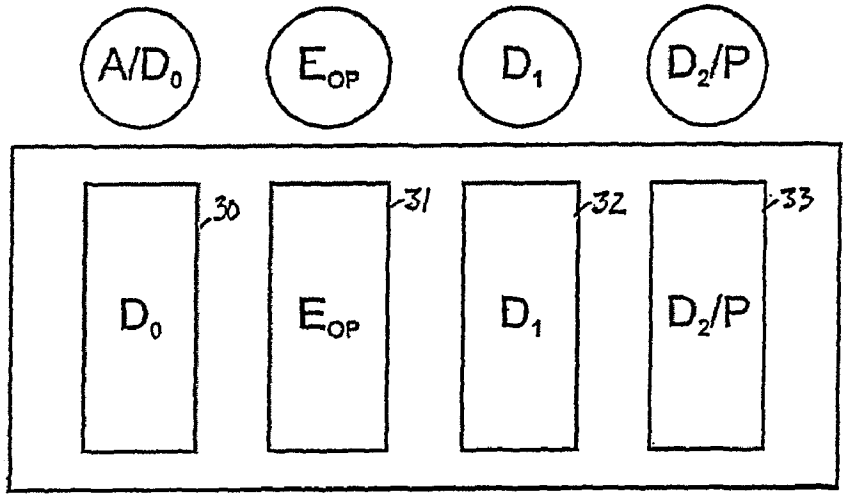
FIG. 3 shows in top view a solution according to prior art (FIG. 3*a*) and to an embodiment according to the invention (FIG. 3*b*) in connection with a four-stage bleaching plant.
Figure 3B:
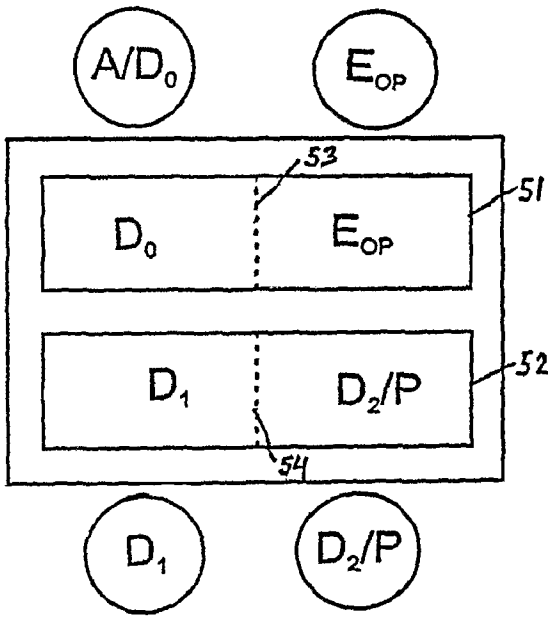

Similar to FIG. 1, FIG. 3 illustrates, what kind of space saving may be achieved by means of the present invention in a four-stage bleaching plant. The pulp is first treated in a $D_0$-stage or in an acid treatment (A) known per se for removing hexenuronic acids (European patent publication 786029), or in a A/$D_0$-stage (2 towers without intermediate washing), or then sequentially in A- and $D_0$-stages with intermediate washing. The treatment of the pulp is then continued in an alkaline $E_{OP}$-stage, a $D_1$-stage, and finally in a $D_2$-stage or peroxide (P-) stage. Between all the stages, the pulp is washed in a prior art solution in separate washing apparatuses 30-33 located in a distance from each other, which disposition requires a remarkable space (FIG. 3*a*). FIG. 3*b* illustrates a solution according to the invention, which only requires two washing apparatuses 51 and 52 separate from each other, because now pulps coming from two different treatment stages are washed in a single washing apparatus in accordance with the invention. The washer arrangement of FIG. 3*b* is illustrated in FIG. 5.

Figure 4:
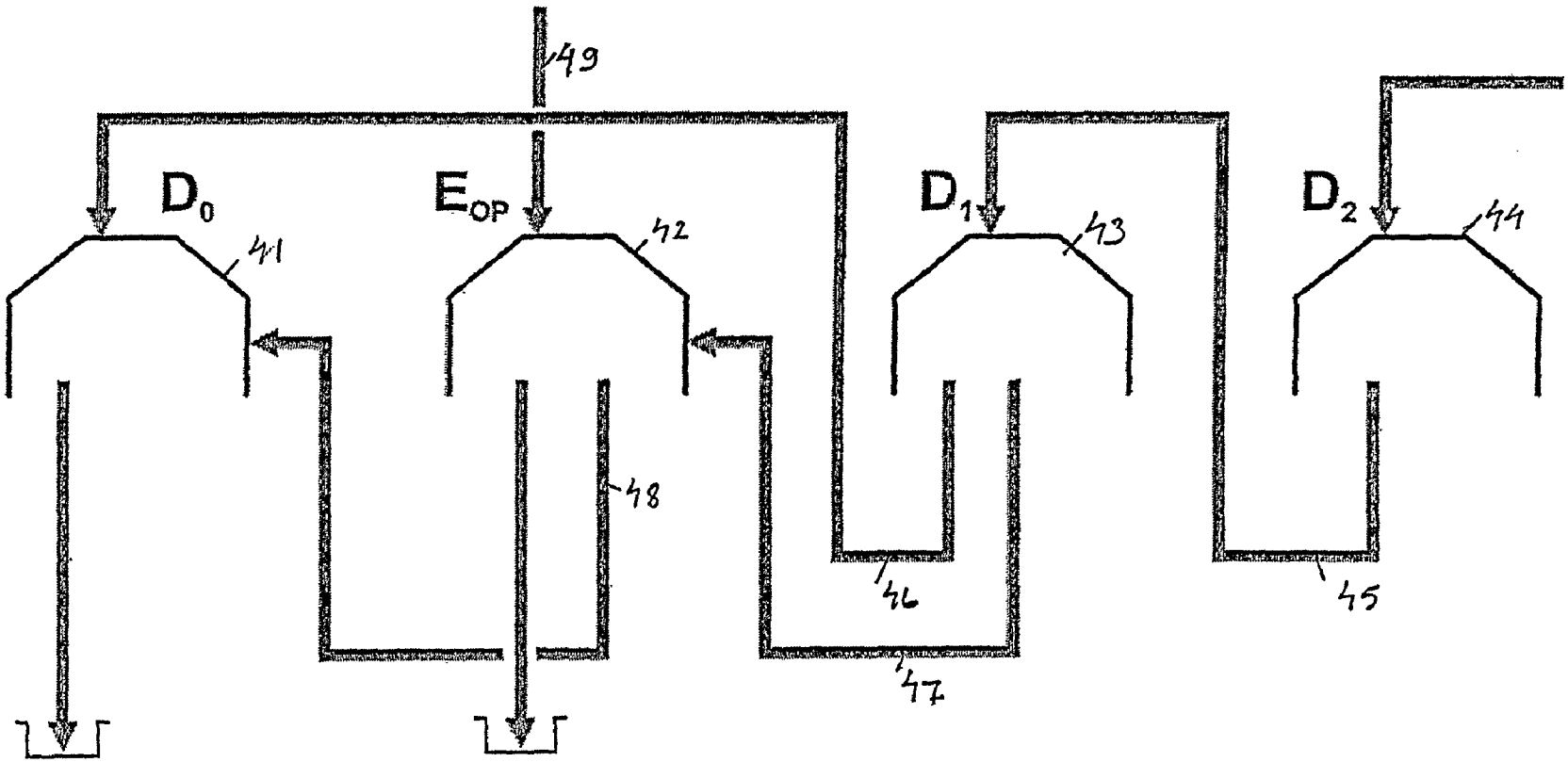
FIG. 4 is a side view of the washing line in the bleaching plant of FIG. 3*a;*

FIG. 4 illustrates in more detail the prior art washer arrangement and coupling of FIG. 3*a*. The bleaching comprises in the pulp flow direction four washers 41-44, i.e. a dedicated washer for each bleaching stage $D_0$, $E_{OP}$, $D_1$ and $D_2$. The washers used in this embodiment are DRUM DISPLACER®-washers (Andritz Oy) capable of fractionating treatment of filtrates, wherefrom the washing filtrate may be obtained in two or more flows. In the example of the figure, all acid filtrate from the $D_0$-washer 41 and alkaline filtrate from the EOP-stage washer 42 is removed from the process. Other filtrates of the process are treated so that the filtrate 45 obtained from the $D_2$-stage washer 44 is led according to countercurrent principle into the $D_1$-stage washer 43 as washing liquid. Foul filtrate 46 obtained from the $D_1$-stage washer is led as first washing liquid into the $D_0$-stage washer 41, to the so-called foul side, and the cleaner filtrate 47 of the $D_1$-stage washer 43 is led to the cleaner side of the EOP-stage washer, i.e. as the second washing liquid of the washer. The first washing liquid used in the foul side of the EOP-washer is fresh water 49. The foul filtrate of the EOP-stage washer is removed from the process and the cleaner filtrate 48 of the EOP-stage washer is taken to the clean side of the $D_0$-stage washer as a second washing liquid of said wash. From the $D_0$-stage washer 41 all the filtrate $F_1$ is discharged and removed from the process.

Figure 5:
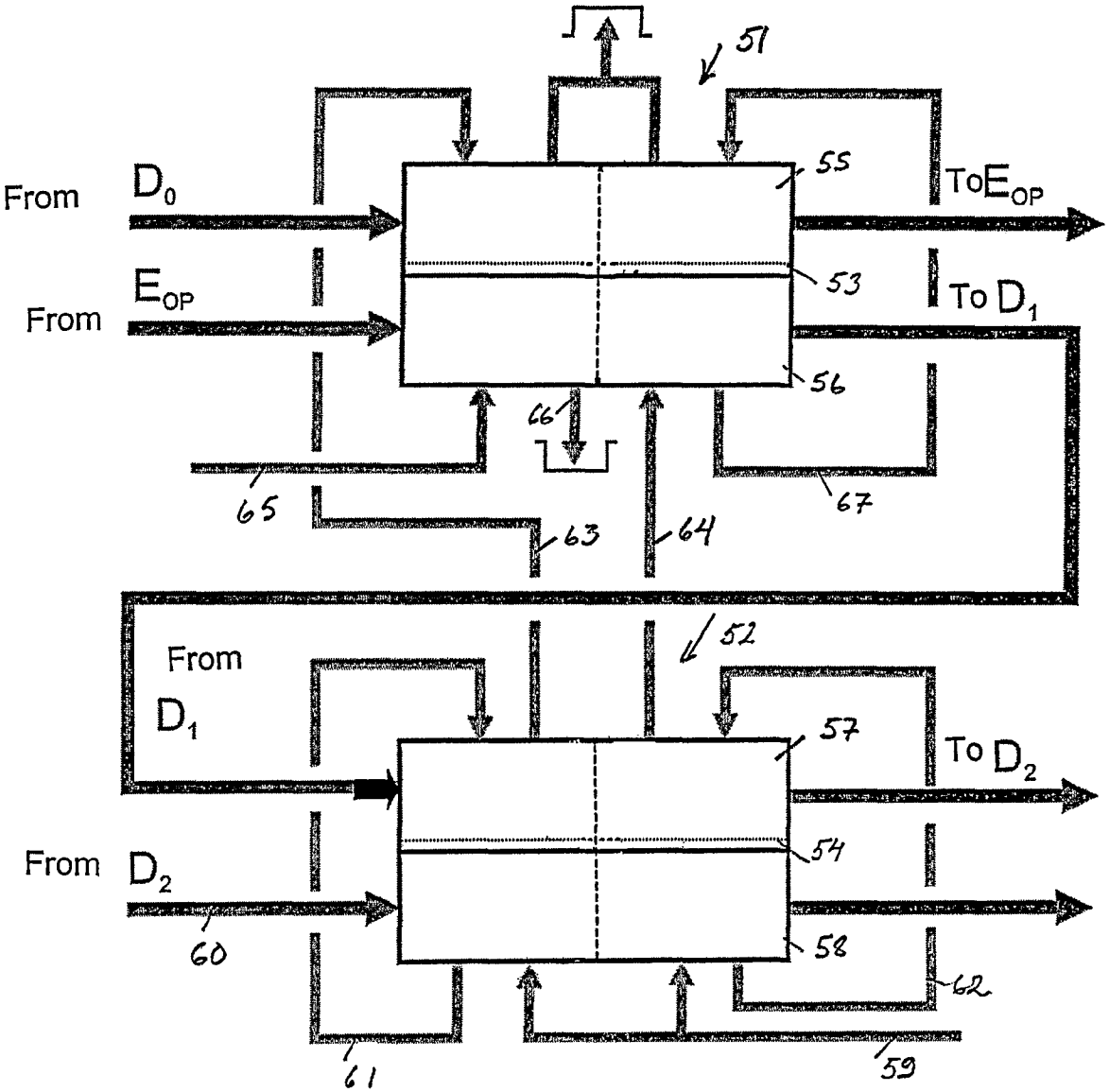
FIG. 5 shows the washer arrangement of the bleaching plant according to FIG. 3*b* in more detail.

FIG. 5 illustrates in more detail the washer arrangement and coupling according to the invention shown in FIG. 3*b* in a way corresponding to FIG. 4, but including the pulp flows. Here there are only two washing apparatuses, 51 and 52, instead of four, 41-44, as each of the washing apparatuses is divided by means of an inside construction, preferably an intermediate wall, to two washing sections (55 and 56; 57 and 58) for pulps introduced from different treatment stages. In each washing section, the pulp is washed with two washing liquids entering from outside the washing section. However, this is not essential in view of the invention, but in each washing section the washing may be carried out in a way that is most preferable in each specific case.

In FIG. 5, the washes in the forward end stages $D_0$ and $E_{OP}$ of the bleaching plant are carried out in one and the same apparatus 51 and the washes in the rear end stages $D_1$ and $D_2$ are carried out in one and the same apparatus 52. Clean washing liquid 59 is introduced into washing section 58 of stage $D_2$ countercurrently in relation to the pulp (i.e. the pulp flows from bleaching stage $D_2$ via line 60), so that the pulp is washed in said washing section in two stages with clean washing liquid. Filtrates 61, 62 obtained from the $D_2$-stage washer section 58 are taken in accordance with countercurrent principle into washing section 57 of stage $D_1$ as washing liquids. In other words, a cleaner filtrate and a fouler filtrate are taken from the $D_2$-stage wash, which filtrates are taken into the $D_1$-stage washing section so that the fouler filtrate 61 is used first for washing the fouler pulp and the cleaner filtrate 62 is used later for washing the cleaner pulp. The foul filtrate 63 from the $D_1$-stage washing section 57 is taken as a first washing liquid into the $D_0$-stage washing section 55 to the so-called foul side and the cleaner filtrate 64 from the $D_1$-stage washing section 57 is taken into the clean side of the EOP-stage washing section 56, i.e. as the second washing liquid of the washer. The first washing liquid in the foul side of the EOP-washing section 56 is fresh water 65. The foul filtrate 66 from the EOP-stage washing section is removed from the process and the cleaner filtrate 67 from the EOP-stage washing is taken into the $D_0$-stage washing section 55 to the clean side as the second washing liquid of said wash. From the $D_0$-stage washing section all the filtrate is discharged and removed from the process.

Figure 6:
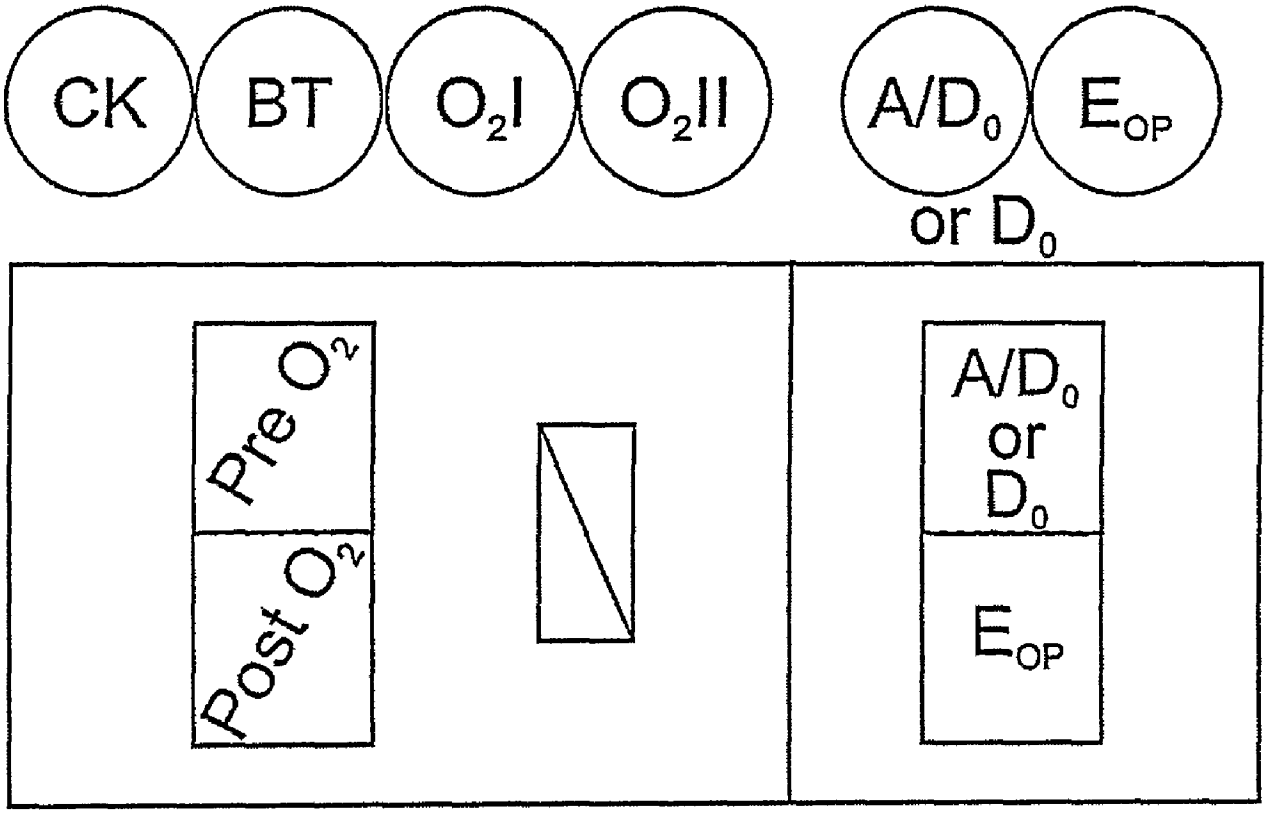
FIG. 6 shows in top view a solution according to the invention.

Similar to FIGS. 1 and 3, FIG. 6 illustrates the space saving obtainable by means of the present invention, when pulp is treated after digestion in an oxygen stage and a bleaching plant. Brown stock from the digester (CK) and blow tank (BT) is led into brown stock washing ($PreO_2$). The washed brown stock is oxygen-delignified in a two-stage oxygen stage comprising reactors ($O_2$I, $O_2$II). The oxygen-delignified pulp is washed in a dedicated wash ($PostO_2$). In accordance with the invention, the wash pre-ceding and following the oxygen stage are carried out in one and the same washing apparatus provided with a separate section for each wash. From the $PostO_2$-wash the pulp is led via screening into a following treatment stage, which typically is an acid treatment (A) for removal of hexenuronic acids, a $D_0$-stage, or an A/$D_0$-stage. Thereafter the pulp is washed and led into an alkaline $E_{OP}$-stage and via washing possibly to other bleaching stages. In accordance with the invention, the wash between the A ($D_0$,A/$D_0$)-stage and the $E_{OP}$-stage and the wash following the $E_{OP}$-stage are carried out in one and the same washing apparatus. Thus, also in the pulp treatment process according to FIG. 6, only two separate washing apparatuses are needed compared to the former four separate washing apparatuses. Due to reduced space requirement and reduced number of apparatuses, the cost saving is remarkable also in this case.

In the above, only a few embodiments of the invention in connection with bleaching are presented. The bleaching may comprise a desired number of stages and it is not limited to certain above-mentioned bleaching chemicals.

The invention claimed is:

1. An apparatus for treating pulp, said apparatus comprising:

at least one liquid-permeable surface moving about a shaft, and onto said surface a pulp layer is formed, wherein the at least one liquid-permeable surface includes a first pulp treatment section and a second pulp treatment section offset from the first pulp treatment section, and wherein the first and second pulp treatment sections rotate simultaneously about the shaft;

a feeder to feed pulp to the apparatus for treatment on the liquid-permeable surface;

an internal barrier dividing the first pulp treatment section and the second pulp treatment section;

the first treatment section receiving from the feeder a first type of pulp and the second treatment section receiving from the feeder a second type of pulp different from the first type, wherein the first type of pulp is supplied to the feeder from a first pulp treatment stage in a pulping system and the second type of pulp is supplied to the feeder from a second pulp treatment stage in the pulping system, and a pulp discharge to discharge treated pulp from the apparatus, wherein the pulp discharge discharges the first type of pulp after treatment separately from discharging the second type of pulp after treatment, and a filtrate discharge to discharge filtrate flowing through the liquid-permeable surface from the apparatus.

2. An apparatus according to claim 1, wherein the internal barrier includes an intermediate wall separating the first treatment section and the second treatment section, and the intermediate wall extends essentially perpendicular to the shaft.

3. An apparatus according to claim 1, wherein the first and second treatment sections each include a washing section and a pressure in the washing section of the first treatment section is substantially the same as a pressure in the washing section of the second treatment section.

4. An apparatus according to claim 3 wherein the first and second treatment sections each include a washing section and each of the washing sections are included in a suction drum washer.

5. An apparatus according to claim 3 wherein the first and second treatment sections each include a washing section and each of the washing sections are included in a pressure drum washer.

6. An apparatus according to claim 3 wherein the first and second treatment sections each include a washing section and each of the washing sections are included in a washing press.

7. An apparatus according to claim 1, wherein the first and second treatment sections each include a wash liquid inlet feeding washing liquid to the pulp in each treatment section.

8. An apparatus according to claim 1, wherein the rotating surface is formed of at least one drum rotating around a drum shaft.

9. An apparatus according to claim 1 wherein the rotating surface includes a plurality of discs.

10. An apparatus according to claim 1 wherein the filtrate discharge includes a first discharge removing filtrate from the first treatment section and a second discharge removing filtrate from the second treatment section separately from the filtrate removed by the first discharge.

11. An apparatus according to claim 1 wherein the apparatus includes a first and a second treatment section, the pulp feeding means of the first thereof being connected to a first treatment stage with first treatment conditions and the pulp feeding means of the second thereof being connected to a second treatment stage with second conditions.

12. An apparatus according to claim 1, wherein the first pulp treatment stage includes a brown stock discharge from a digesting plant and the second pulp treatment stage includes a pulp treatment stage in which at least one of an acid, oxygen and a bleach chemical treats the first type of pulp discharged from the pulp discharge.

13. An apparatus according to claim 1, wherein the first pulp treatment stage includes a first bleaching stage for treating the first type of pulp before the first type of pulp is fed to the feeder, and the second pulp treatment stage includes a second bleaching stage for treating the second type of pulp before the second type of pulp is fed to the feeder.

14. An apparatus according to claim 1 wherein the first and second treatment sections each include a washing section, and in at least one of the washing sections two different washing liquids are applied to the pulp being treated.

15. A method to treat pulp in a treatment apparatus, the method comprising:

feeding pulp onto a liquid-permeable surface moving about a shaft of the treatment apparatus;

forming a first layer of pulp on a first zone of the liquid-permeable surface wherein the first layer of pulp is formed of pulp supplied from a first pulp treatment stage;

forming a second layer of pulp on a second zone of the liquid-permeable surface wherein the second zone is separated from the first zone along a direction parallel to the shaft, and the second layer of pulp is formed of pulp supplied from a second pulp treatment stage;

treating the first layer of pulp by passing a first liquid through the first layer and the liquid-permeable surface while the first zone rotates about the shaft, and removing the first liquid as filtrate;

treating the second layer of pulp by passing a second liquid through the second layer and the liquid-permeable surface while the second zone rotates about the shaft simultaneously with said rotation of the first zone, and removing the second liquid as a second filtrate, and removing from the surface the treated pulp in the first layer and in the second layer.

16. A method according to claim 15 wherein the first liquid and second liquid have substantially the same composition.

17. A method according to claim 16 wherein the first liquid and second liquid are water.

18. A method according to claim 15, wherein forming the first and second pulp layers includes forming a barrier between the first and second zones to prevent leakage between the zones.

19. A method according to claim 15 wherein the treating of the first and second pulp layers includes washing the first and second pulp layers.

20. A method according claim 15, wherein the first liquid includes the second filtrate.

21. A method according to claim 15, wherein each zone is segmented into at least two successive washing stages, wherein the first layer is treated by being washed in a first washing section and in a second washing section, and filtrate from the second washing section is applied to the first layer as a washing liquid in the first washing section.

22. A method according to 21 wherein filtrate from the first washing section flows separately from the filtrate removed in the second washing section.

23. A method according to claim 21 wherein a first washing liquid is applied to the first layer in the first washing section and a second washing liquid, different from the first washing liquid, is applied to the first layer in the second washing section.

24. A method to treat pulp in a treatment apparatus, the method comprising:

feeding pulp onto a liquid-permeable surface rotating around a shaft of the treatment apparatus;

forming a first layer of pulp on a first zone of the liquid-permeable surface, wherein the first layer of pulp is formed of a brown stock pulp supplied from a first pulp treatment stage;

forming a second layer of pulp on a second zone of the liquid-permeable surface wherein the second zone is separated from the first zone along a direction parallel to the shaft, and a second layer of pulp is formed of an oxygen-delignified pulp supplied from a second pulp treatment stage;

treating the first layer of pulp by removing a first liquid through the first layer and the liquid-permeable surface while the first zone rotates about the shaft, and removing the first liquid as filtrate from the apparatus;

treating the second layer of pulp by removing a second liquid through the second layer and the liquid-permeable surface while the second zone rotates about the shaft simultaneously with said rotation of the first zone, and removing the second liquid as filtrate from the apparatus, and removing from the surface the treated pulp in the first layer and in the second layer.

25. A method to treat pulp in a treatment apparatus, the method comprising:

feeding pulp onto a liquid-permeable surface rotating around a shaft of the treatment apparatus;

forming a first layer of pulp on a first zone of the liquid-permeable surface, wherein the first layer is formed of pulp from a first bleaching stage;

forming a second layer of pulp on a second zone of the liquid-permeable surface wherein the second zone is separated from the first zone along a direction parallel to the shaft, and the second layer is formed of pulp supplied from a second bleaching stage;

treating the first layer of pulp by removing a first liquid through the first layer and the liquid-permeable surface while the first zone rotates about the shaft, and removing the first liquid as filtrate from the apparatus;

treating the second layer of pulp by removing a second liquid through the second layer and the liquid-permeable surface while the second zone rotates about the shaft simultaneously with said rotation of the first zone, and removing the second liquid as filtrate from the apparatus, and removing from the surface the treated pulp in the first layer and in the second layer.

26. A method to treat pulp in a treatment apparatus, the method comprising:

feeding pulp onto a liquid-permeable surface rotating around a shaft of the treatment apparatus;

forming a first layer of pulp on a first zone of the liquid-permeable surface, wherein the first layer is formed of pulp from an acid stage;

forming a second layer of pulp on a second zone of the liquid-permeable surface wherein the second zone is separated from the first zone along a direction parallel to the shaft, and the second layer of pulp is formed of pulp from an alkali extraction stage;

treating the first layer of pulp by removing a first liquid through the first layer and the liquid-permeable surface while the first zone rotates about the shaft, and removing the first liquid as filtrate from the apparatus;

treating the second layer of pulp by removing a second liquid through the second layer and the liquid-permeable surface while the second zone rotates about the shaft simultaneously with said rotation of the first zone, and removing the second liquid as filtrate from the apparatus, and removing from the surface the treated pulp in the first layer and in the second layer.

27. An apparatus for treating pulp comprising:

a liquid-permeable surface arranged to move around a shaft, wherein the surface is divided into a first pulp treatment section and a second pulp treatment section;

a barrier wall adjacent the liquid-permeable surface and separating the first pulp treatment section and the second pulp treatment section, wherein the barrier wall extends along a direction essentially perpendicular to the shaft;

the first treatment section aligned with a feeder feeding a first type of pulp and the second treatment section aligned with a feeder feeding a second type of pulp which is different than the first type, and a pulp discharge to discharge treated pulp from the apparatus, wherein the pulp discharge includes a first discharging unit aligned with the first treatment section and a second discharging unit aligned with the second treatment section, and a filtrate discharge to discharge from the apparatus filtrate flowing through the liquid-permeable surface.

* * * * *